US005350238A

United States Patent [19]

Bolton

[11] Patent Number: 5,350,238

[45] Date of Patent: Sep. 27, 1994

[54] SECURITY BAGS

[75] Inventor: Geoffrey A. Bolton, Lancashire, England

[73] Assignee: Learoyd Packaging Limited, Lancashire, England

[21] Appl. No.: 18,400

[22] Filed: Feb. 17, 1993

[30] Foreign Application Priority Data

Feb. 20, 1992 [GB] United Kingdom ..... 9203606

[51] Int. Cl.[5] ..... B65D 33/18; B65D 33/34

[52] U.S. Cl. ..... 383/5

[58] Field of Search ..... 383/5

[56] References Cited

U.S. PATENT DOCUMENTS 4,483,018 11/1984 Whelan ..... 383/5

4,941,196 7/1990 Edelman et al. ..... 383/5

*Primary Examiner*—Stephen P. Garbe

*Attorney, Agent, or Firm*—Oliff & Berridge

[57] ABSTRACT

A security bag (10) comprises front and back portions (14) and (16) welded together and defining an opening (20). The back portion (16) includes a flap (16A) having a line of weakness (22). A void tape (24) is attached to the front portion (14) of the bag either directly or indirectly and the back portion (16) of the bag is provided with a strip (34) of non-contact adhesive positioned so that it can be overlaid by that part of the layer (24) which is not attached to the front portion (14).

9 Claims, 1 Drawing Sheet

SECURITY BAGS

FIELD OF THE INVENTION

This invention relates to security bags and in particular to bags which can be checked for evidence as to whether any tampering of the bags has taken place subsequent to the sealing of the bags once articles have been placed within the bags.

BACKGROUND OF THE INVENTION

Security bags of this type are useful for the transport and distribution of valuable items by mail or any other means. Also such bags can be used for the storage of valuable items.

Security for the above purpose or purposes are usually made from sheet plastics material such as polythene. Such bags can be made from a single continuous web of plastics material or two overlaid webs of material so that the bottom and side edges of the bag are closed, leaving a pocket having an opening enabling articles to be placed within the bag. The bag can have a protected graphics tape coated with pressure-sensitive adhesive on the body of the bag so that once the bag is sealed, access to the bag cannot take place without there being some evidence of tampering with the bag to extract the items within the bag.

However it may be possible to remove the protected graphics tape and open the bag without leaving any signs of tampering.

SUMMARY OF THE INVENTION

The present invention seeks to provide a security bag in which the tape is attached to the bag in such a way that the bond between the adhesive and the bag is greater than the bond between the tap and the adhesive.

Accordingly the present invention provides a security bag comprising a front and back portion, both portions being closed along the bottom and side edges and defining a pocket having an opening for the insertion of articles into the bag. Either the front or back portion has a void tape layer and a layer of adhesive superposed on the void tape layer, the adhesive layer being provided with a removable release strip. The bag has a strip of non contact adhesive on at least one of the bag portions engageable by the void tape layer. The adhesive layer can comprise a mixture of solvent and non-solvent adhesive.

The non-contact adhesive strip can be provided on the back portion, and the void tape layer can be attached to the front portion. The void tape layer can be attached to the front portion by a further strip of non-contact adhesive.

In another arrangement, the void tape layer can be attached directly to the back portion or by using a non-contact adhesive strip on the back portion, and another strip of non-contact adhesive can be provided on the front portion so as to be engageable by the adhesive on the void tape layer.

The bag can have a flap provided with a line of weakness enabling a portion of the flap to be removed.

BRIEF DESCRIPTION OF THE DRAWINGS

The present invention will now be more particularly described with reference to the accompanying drawings in which.

DETAILED DESCRIPTION OF PREFERRED EMBODIMENTS

Figure 1:
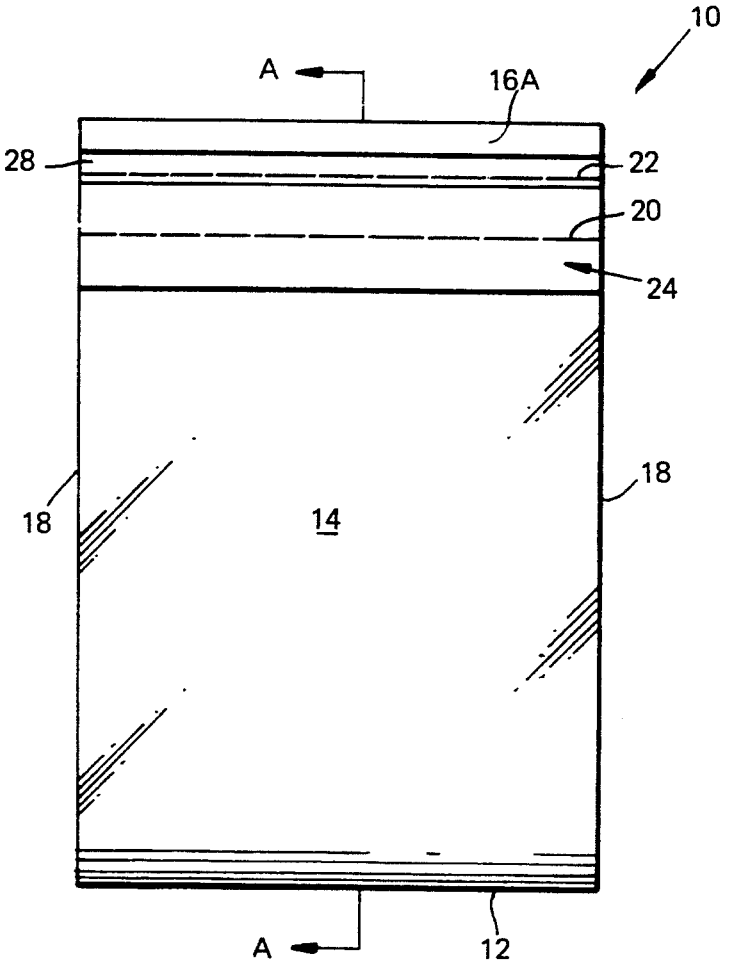
FIG. 1 shows an elevation of one form of security bag according to the present invention.
Figure 2:
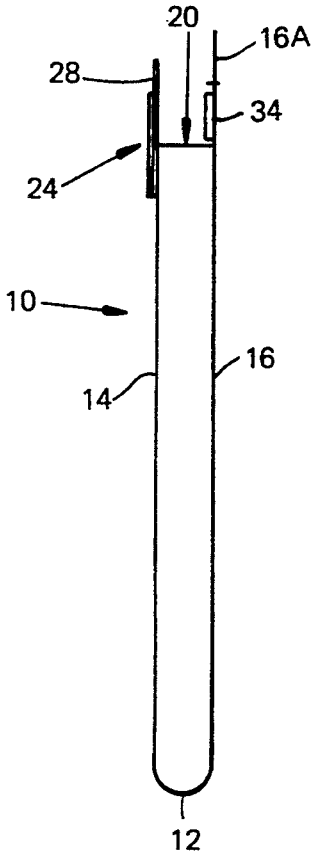
FIG. 2 shows a section on line A—A of the bag shown in FIG. 1.
Figure 3:
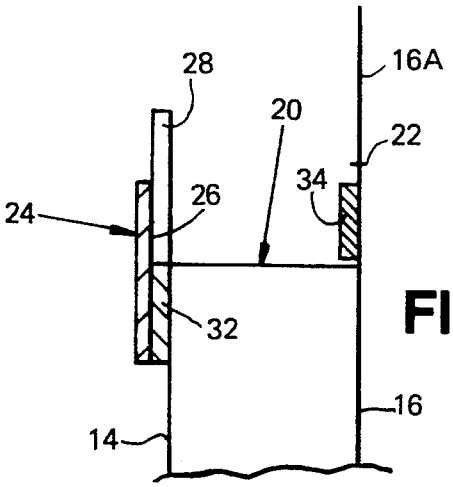
FIG. 3 is a view of part of the bag shown in FIGS. 1 and 2 to an enlarged scale.

Referring to the drawings, a security bag (10) is formed from a continuous length of synthetic plastics material such as polythene which is folded to provide a bottom (12) to the bag and front and back portions (14) and (16) respectively of the bag.

The front and bag portions (14) and (16) are welded together along a weld line (18) on each side of the bag so that an opening (20) is defined between the front and back portions enabling articles to be placed within the bag.

The back portion (16) includes a flap **(16*a*) which has a line of weakness (22) on the back portion (16)**.

A void tape (24) including for example a layer of polyester has a layer of pressure sensitive hot melt adhesive (26), and is preprinted on the polyester layer with a further layer comprising a release chemical in the form of invisible wording and then overprinted with a solid block of color. This can be done using a highly solvent sensitive ink. This system is known as protected graphics available from the 3M company or any of their authorized suppliers.

A high density polythene release backing tape (28) is located on the outer surface of the hot melt adhesive layer (26). The adhesive layer can be a combination of solvent and non solvent based adhesive.

Layer (24) is attached to the front portion (14) of the bag directly using the adhesive layer (26) or indirectly via a strip (32) of non-contact adhesive on the front portion (14) as shown in the figures.

The back portion (16) of the bag is also provided with a strip (34) of non-contact adhesive, the strip being positioned and of a width, so that it can be overlaid by that part of the layer (24) which is not attached to the front portion (14).

In order to use the security bag (10) items, for example, bank notes are placed in the bag through the opening (20) and the release strip (28) is peeled from the adhesive layer (26). The free width of the layer (24) is then attached to the back portion using the adhesive layer (26) and the non-contact adhesive strip (34).

The flap **(16*a*) can then be removed by tearing along the line of weakness (22) and this portion of the flap (16*a*)** can take the form of a receipt.

If any attempt is made to remove the layer (24) the bond between the adhesive (26) and the bag via the adhesive strips (32), (34) will be greater than the bond between the adhesive (26) and the layer (24).

The protected graphics layer (24) will then operate in such a way that the ink printed over the release chemical will key to the front of the bag (14) and the rest of the printed solid block of color will key to the tape (24). Attempts to replace the layer (24) will not re-register the breaking of the printed area, and the invisible wording will be rendered visible. It will therefore be immediately apparent that an attempt has been made to gain access to the bag.

A security bag according to the invention has been described using a strip of non-contact adhesive on both the front and back portions of the bag in order to secure the protected graphics layer (24) to the front portion, and to seal the bag by adhesion to the back portion.

However, the non-contact adhesive strip can be applied not only to both front and back portions but to either portion.

Thus the layer (24) can be attached indirectly to the front portion using a non-contact adhesive strip (32) and directly to the back portion using the adhesive layer (26). Also, the layer (24) can be attached directly to the front portion using the adhesive layer (26) and indirectly to the back portion to seal the bag, using the non-contact adhesive strip (34).

It will be appreciated that a security bag according to the present invention provides a method and means of closing the bag such that there will be evidence of tampering if any attempt is made either to remove the layer (24) from the front or the back of the bag.

Also the use of solvents, or the application of heat or cold to the various adhesive layers will immediately show evidence of tampering.

I claim:

1. A security bag, comprising:

an enclosure formed from first and second panels having an access opening along an edge of the enclosure for insertion of articles into the enclosure;

a void tape layer having a first adhesive layer superposed on the void tape layer, the void tape layer being attached to the first panel at the access opening, wherein the void tape layer and the first adhesive layer extend beyond the first panel such that a portion of the adhesive is exposed for connection, the exposed portion comprising a first mating portion provided with a removable release strip; and a second adhesive layer being disposed on the second panel comprising a second mating portion on the second panel, wherein the first and second mating portions are positioned to face each other and a seal is formed by a translational movement of the mating portions when the removal release strip is removed.

2. A security bag as claimed in claim 1, wherein the second adhesive layer comprises a non-contact adhesive strip.

3. A security bag as claimed in claim 1, wherein an adhesive bond between the first adhesive layer and the security bag is greater than an adhesive bond between the first layer of adhesive and the void tape layer.

4. A security bag as claimed in claim 1, wherein the void tape comprises protected graphics tape comprising a layer of polyester preprinted with a release chemical layer in the form of invisible wording and overprinted with a solid block of color, the first adhesive layer comprising a layer of pressure sensitive hot melt adhesive.

5. A security bag as claimed in claim 1 wherein the first adhesive layer comprises a mixture of solvent and non-solvent adhesive.

6. A security bag as claimed in claim 1, wherein the second adhesive layer comprises a non contact adhesive strip provided on the second panel and the void tape layer is connected to the first panel.

7. A security bag as claimed in claim 6, wherein the void tape layer is attached to the first panel by a strip of non-contact adhesive.

8. A security bag as claimed in claim 1, wherein the void tape layer is attached to the second panel by a non-contact adhesive strip on the second panel.

9. A security bag as claimed in claim 1, comprising:

a flap in connection with one of the first and second panels and having a line of weakness enabling a portion of the flap to be removed.

* * * * *